United States Patent [19]

Lindae

[11] 3,987,326

[45] Oct. 19, 1976

[54] SEALED-BEAM HEADLIGHT

[75] Inventor: Gerhard Lindae, Leonberg, Germany

[73] Assignee: Robert Bosch G.m.b.H., Stuttgart, Germany

[22] Filed: Feb. 15, 1974

[21] Appl. No.: 443,153

[30] Foreign Application Priority Data

May 10, 1973 Germany ..... 2323520

[52] U.S. Cl. ..... 313/113; 240/41 SB; 313/290; 313/318

[51] Int. Cl.[2] ..... F21M 3/00; F21V 7/02; H01K 1/38

[58] Field of Search ..... 313/113–115, 313/222, 290, 331, 332, 335, 315, 318; 240/41.25, 41.3, 41.35 R, 41 SB, 41 SC, 41 BM, 41.5, 41.55

[56] References Cited

UNITED STATES PATENTS

| | | | |
|---|---|---|---|
| 2,190,528 | 2/1940 | Wright | 313/113 |
| 2,317,035 | 4/1943 | Dana | 313/113 X |
| 3,314,331 | 4/1967 | Wiley | 240/41.3 X |
| 3,397,307 | 8/1968 | Cibie | 240/41.3 |
| 3,488,543 | 1/1970 | De Ridder et al. | 313/113 |
| 3,493,806 | 2/1970 | Jacobs et al. | 313/113 |
| 3,510,718 | 5/1970 | Vetere | 313/331 X |
| 3,732,415 | 5/1973 | Lindae | 313/318 X |
| 3,885,149 | 5/1975 | Wolfe et al. | 313/318 X |

*Primary Examiner*—Siegfried H. Grimm
*Attorney, Agent, or Firm*—Michael J. Striker

[57] ABSTRACT

A cup-shaped reflector has a larger open end and a smaller open end. A diffuser glass closes off the larger open end. A lamp is comprised of a lamp bulb having a fused, squashed-flat rear portion hermetically sealing the interior of the bulb, with a plurality of lamp electrodes passing through the squashed-flat rear portion of the lamp bulb and embedded within the material of the squashed-flat rear portion of the lamp bulb. A plurality of lugs is provided, each connected to one of the lamp electrodes at the rear of the lamp, in electrically conductive engagement with the electrodes. A mounting arrangement mounts the lamp bulb on the reflector in the region of the smaller open end of the reflector with at least part of the lamp bulb projecting forwardly into the interior of the reflector.

24 Claims, 3 Drawing Figures

SEALED-BEAM HEADLIGHT

BACKGROUND OF THE INVENTION

The invention relates in general to headlights, particularly for use on automotive and other vehicles, of the so-called "sealed-beam" type.

Hermetically sealed vehicular headlights are being manufactured in greater and greater numbers, because they are characterized by trouble-free operation over longer periods of time than is in general the case with headlights of the removable-bulb type. It is known for example to provide a sealed-beam headlight comprised of individual elements, such as a reflector, a diffuser glass and a light source, which are joined together to form a structure which cannot be disassembled, with the interior of the headlight being filled with an inert protective gas, to protect in particular the reflective material of the reflector. Such a headlight can become useless when it develops even a relatively small defect, and must be thereupon replaced by a new unit; nevertheless, these hermetically sealed deadlights are increasingly prevalent, because damaging chemically reactive gases and exhausts and atmospheric moisture is effectively prevented from penetrating into the interior of the headlight. This prevents a decrease of the reflective ability of the reflecting surface of the reflector or even actual rusting of the reflecting surface, and also prevents misting of the interior surface of the diffusing lens, all of which possibilities are very real with the current degree of air pollution.

A headlight of the type in question is already known provided with a diffuser lens connected to the headlight reflector by means of a cementing material, such as glue or putty or hardenable plastic or the like, with the filament-supporting electrodes of the headlight lamp passing through a metal lamp socket in air-tight manner, and with a cap-shaped annular mounting flange on the lamp being welded to the rear edge of the reflector. Other known headlights of this type make use of a lamp provided with an annular groove, with the rear neck portion of the reflector member being retained in such annular groove by means of a cementing material; in an analogous manner, the front rim of the reflector member is received in a groove in the diffuser glass or lens and maintained in position by means of a cementing material. This expedient has the special advantage that the edges of the front rim of the reflector, which are most susceptible to rusting, are embedded in the cementing material and thereby protected.

A further known construction makes use of a glass socket through which pass the electrodes of the headlight lamp, with the glass socket being provided with a metal centering ring, this centering ring being inserted into the rear opening of the reflector. In this way, a glass bulb can be mounted on the centering ring, so that the electrodes with their filaments are encapsulated in the interior of the reflector. This arrangement enables a trouble-free orienting of the lamp filaments with reference to the reflector, without the separate bulb socket which is also provided for the lamp in this construction necessarily playing a part in the focussing adjustment.

SUMMARY OF THE INVENTION

It is the general object of the present invention to provide a headlight of the sealed-beam type which is superior to the constructions known in the prior art.

It is more particularly an object of the invention to provide a headlight of the sealed-beam type which is simpler in construction, easier to assemble, and less expensive to assemble than is the case with known constructions.

These objects, and also others which will become understandable from the description below of exemplary embodiments, can be met, according to one advantageous concept of the invention by providing a gas-tightly sealed headlight for automotive vehicles, and the like, which comprises a cup-shaped reflector having a larger open end and a smaller open end. A diffuser glass closes off the larger open end. A lamp, preferably a halogen lamp, has a lamp bulb having a fused, squashed-flat rear portion hermetically sealing the interior of the bulb, with a plurality of lamp electrodes passing through the squashed-flat rear portion of the lamp bulb and being embedded within the material of the squashed-flat rear portion of the lamp bulb. A plurality of lugs is provided, each connected to one of the lamp electrodes at the rear of the lamp in electrically conductive engagement with the respective electrode. Mounting means mounts the lamp bulb on the reflector in the region of the smaller open end of the reflector with at least part of the lamp bulb projecting forwardly into the interior of the reflector.

A possibilty of particular advantage according to the invention is to dispense with the prior-art expedient of providing a separate socket which receives the headlight lamp and in which the headlight lamp is positioned and held by means of a cementing material. Instead, it is considered preferable to provide a mounting member, preferably a circular mounting member having a central portion which is connected to and supports the headlight lamp within the reflector and furthermore having a radially more outer portion permanently connected to the reflector in the region of the rear open end of the reflector.

In a disclosed exemplary possibility, the lamp electrodes pass through openings in the above-mentioned mounting member, being guided by tubular members which surround the lamp electrodes as they pass through such openings and which are mounted in place on such mounting member by means of glass melts. For example, these tubular members may themselves be of glass and be mounted in place in the openings of the mounting member by being melted to engage and embed the rims of such openings. With this approach, the material of the mounting member will be exposed to relatively high temperatures, and accordingly it is considered advantageous to make the aforementioned mounting member from high-grade steel. As a further possibility, the mounting member can have a central opening which accommodates a squashed-flat rear portion of a lamp bulb and in which such rear portion is positioned and held by a cementing material.

According to another possibility, the aforementioned tubular members can be partially fused with or embedded within the material of the squashed-flat rear portion of the lamp bulb, with the remainder of such tubular members projecting rearwardly out of the rear portion of the lamp bulb. In this case, the mounting member can be a circular flat mounting member provided with a plurality of central openings, one for each electrode, each opening accommodating the rear portion of the tubular guide members, with the tubular guide members being fixed on the mounting member by means of glass melts. With this approach, the desired geometry of the arrangement need be established only when the mounting member is permanently connected to the rear end of the reflector. In other words, a single final focussing of the orientation of the lamp relative to the reflector need be performed only when the assembly comprised of the lamp and the permanently connected mounting member is actually inserted into the rear end of the reflector and the mounting member permanently connected to the reflector; this greatly simplifies the assembly of the arrangement and constitutes a significant advance over assembly techniques employed in the prior art.

According to another possibility, the tubular guide members can be partially embedded or be partially fused into the material of the squashed-flat rear portion of the lamp bulb, with the projecting portions of the tubular guide members not being connected directly to the mounting member. Instead, the mounting member can be provided with a larger central opening having an inner peripheral portion, with such inner peripheral portion being entirely embedded within the material of the squashed-flat rear portion of the lamp bulb. This results in a structure which is very rigid and shake-proof. Also this approach has the advantage that only a single central opening need be provided in the mounting member.

A very important advantage of the invention is that the individual elements of the construction, such as the lamp bulb, the mounting member and the lugs which are connected to the lamp electrodes at the rear of the lamp bulb, can be preassembled to form, if desired, a pre-focussed assembly unit, which is then subsequently connected as a whole to the headlight reflector in gas-tight manner, with the final focussing or orientation of the lamp relative to the reflector being performed at such time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the acompanying drawing.

DESCRIPTION OF THE PREFERRED EMBODIMENTS

Figure 1:
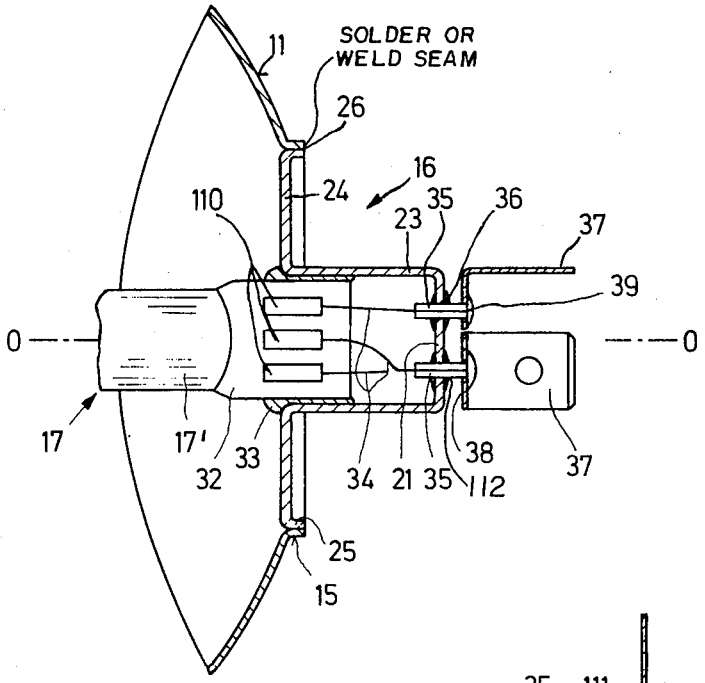
FIG. 1 depicts a first exemplary embodiment of the invention.

FIG. 1 depicts a first exemplary headlight construction. The headlight includes a cup-shaped reflector 11 having a larger open end closed off by a diffuser glass or lens and a rear smaller open end provided, in this embodiment, with an axially extending tubular neck portion 15. The headlight further includes a circular mounting member generally designated by reference numeral 16, and comprised in this embodiment of a radially extending annular flange 24 provided with an axially extending rim portion 25, and a cup-shaped portion comprised of a cylindrical side wall portion 23 and a flat bottom wall portion 21. The bulb 17' of a halogen lamp 17 is positioned in the central opening of the mounting member 16 and is positioned and supported therein by means of cementing material 33, such as putty or glue. The cementing material 33 establishes a gas-tight connecton between the facing peripheral surfaces of the member 16 and the bulb 17'.

The rear portion 32 of the bulb 17' is squashed-flat, with the fused sides of such squashed-flat rear portion embedding within the material thereof three molybdenum strips 110. Connected to each of the molybdenum strips is a respective electrode 34, which passes out of the squashed-flat rear portion of the bulb 17'. The rear portion of each of these three electrodes (of which only two are shown, for clarity) is guided through a respective one of three tubular glass members 35. The guide members 35 are preferably made of VACON. The tubular guide members 35 are maintained in position in central openings 112 of the bottom wall 21 of the mounting member 16 by means of glass melts. If the tubular guide members 35 are themselves of glass, each can be mounted by softening the material of the member 35 until such material embeds the periphery of the respective opening 112. Connected to each of the electrodes 34 in electrically conductive relationship is a respective lug 37, configurated as plugs which can be inserted into sockets, and connected to the respective electrodes 34 by means of solder connections 39.

The thus-formed assembly unit consisting of the mounting member 16, the lamp bulb 17' and the lugs 37 is not finally focussed relative to the optical axis 0—0; the proper orientation of these components relative to the optical axis is effected only when the radially outer portion of the mounting member 26 is permanently connected to the reflector 11 at the rear open end thereof. Such connection can be effected between the annular rim 25 of member 16 and the tubular neck 15 of reflector 11 by means of a weld seam 26 or by means of a solder seam, this connection being gas-tight. When the tubular guide members 35 are mounted in the openings 112 of wall 21 by the formation of glass melts, relatively high temperatures will be employed, so that the mounting member 16 is advantageously formed of a temperature-resistant material, such as high-grade steel. The protective coatings of surface-treated sheet metal would be destroyed upon the formation of the glass melts 36.

When securing the lamp bulb 17' in the central opening of member 16 by means of the cementing material 33, care must be taken to assure that the connection is strong enough to preclude the possibility of a coming loose of the bulb 17' as a result of vibrational stresses.

Figure 2:
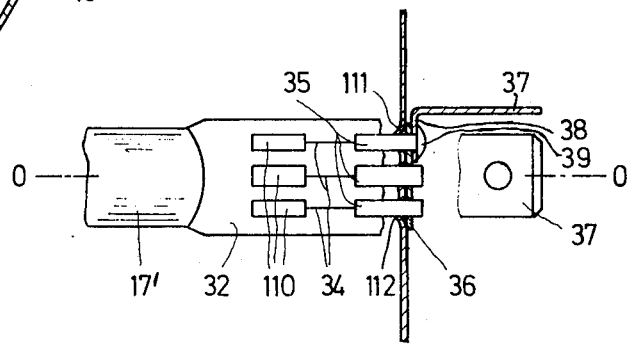
FIG. 2 depicts a second exemplary embodiment of the invention.

FIG. 2 depicts a second embodiment. The three tubular guide members 35 are formed from glass and are again secured in central openings 112 of a mounting member 111, which is here a flat mounting disk. The guide members 35 are again embedded in or fused with the material of the squashed-flat rear portion of bulb 17'. However, in FIG. 2 the members 35 are only partially so embedded, with the remainder of the members 35 projecting rearwardly out from the rear end of bulb 17'. In this embodiment, the projecting portions of the tubular guide members 35 are secured in position in the openings 112 by means of a cementing material 36, which establishes a gas-tight connection at these locations. Also secured in place by means of the cementing material 36 are the arms 38 of the lugs 37, the arms 38 being connected to the respective electrodes 34 by means of solder connections 39. In contrast to the mounting member 16 of FIG. 1, the mounting member 111 of FIG. 2 is plate-shaped, so that connection of the mounting member 111 to the reflector 11 and the simultaneous focussing operation do not require a neck portion 15.

Figure 3:
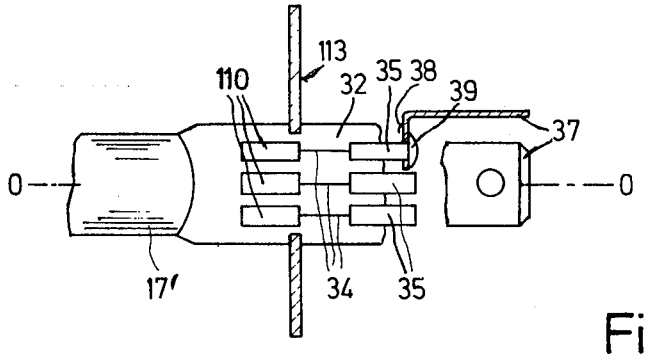
FIG. 3 depicts a third exemplary embodiment of the invention.

FIG. 3 depicts a third embodiment. As in FIG. 2, three tubular guide members 35 made of glass are partially embedded within or fused to the material of the squashed-flat rear portion of lamp bulb 17', with the remainder of guide members 35 projecting rearwardly out of the back of bulb 17'. A lug 37 is connected to each of the electrodes 34 at the rear end of the respective member 35 by means of a solder connection 39, this solder connection being capable of furthermore effecting a secure connection between each member 35 and the arm 38 of the respective lug 37. In contrast to the embodiment of FIG. 2, the mounting member 113 is provided with a central opening and has an inner peripheral portion which is entirely embedded within the material of the squashed-flat bulb section 32. The radially outer portion of the mounting member 113 can be connected to the reflector 11 at the rear end of the latter by means of solder or welding, as explained before.

The illustrated embodiments are each characterized by the advantage that it is possible to assemble a unit comprised of the mounting member 16, the lamp bulb 17' and the lugs 37, thereby requiring only a single prefocussing; only when the mounting member 16 is hermetically sealed to the reflector 11 is the final focussing of the unit performed.

In the event that welding together of the high-grade-steel mounting member 16 and the reflector 11 is not advantageous in a particular situation, use can also be made of sealing and cementing substances, which have the advantage that they prevent corrosion at the connected locations.

It will be understood that each of the elements described above, or two or more together, may also find a useful application in other types of constructions differing from the types described above.

While the invention has been illustrated and described as embodied in a sealed-beam headlight for a vehicle, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a gas-tightly sealed headlight for automotive vehicles and the like a combination comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes; and mounting means mounting said lamp bulb on said reflector in the region of said smaller open end of said reflector with at least part of said lamp bulb projecting forwardly into the interior of said reflector, wherein said cup-shaped reflector is a one-piece body, wherein said mounting means includes one and only one circular mounting member having a radially outer portion and having a central opening, at least a portion of said squashed-flat rear portion of said lamp bulb being received within said central opening, and wherein said mounting member and said reflector together constitute a weldment exhibiting a gas-tight annular weld seam at said radially outer portion of said mounting member in the region of said smaller open end of said reflector, wherein said circular mounting member has a plurality of openings in the central portion thereof, wherein each of said electrodes extends from said squashed-flat rear portion of said lamp bulb across free space a predetermined distance and then passes through a respective one of said plurality of openings, and wherein said mounting means further includes a plurality of glass melts, each glass melt completely surrounding a respective one of said electrodes at the portion of the respective electrode located within the respective one of said plurality of openings and gas-tightly sealing the respective one of said plurality of openings.

2. In a headlight as defined in claim 1, wherein said lugs are projecting lugs of a configuration and stiffness rendering them insertable into sockets.

3. In a headlight as defined in claim 1, including at least one body of solder connecting said lugs to said electrodes.

4. In a headlight as defined in claim 1, said mounting means further including a body of cementing material filling the space intermediate the periphery of said squashed-flat rear portion of said bulb and the periphery of said central opening gas-tightly mounting said lamp bulb in said central opening.

5. In a headlight as defined in claim 3, wherein said lamp is a halogen lamp.

6. In a gas-tightly sealed headlight for automotive vehicles and the like a combination, comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes and mounting means mounting said lamp bulb on said reflector in the region of said smaller open end of said reflector with at least part of said lamp bulb projecting forwardly into the interior of said reflector, wherein said mounting means comprises a circular mounting member having a radially outer portion and having a central opening, means gas-tightly connecting said radially outer portion of said circular mounting member to said reflector in the region of said smaller open end of said reflector, at least a portion of said squashed-flat rear portion of said lamp bulb being received within said central opening, and said mounting means further including a body of cementing material filling the space intermediate the periphery of said squashed-flat rear portion of said bulb and the periphery of said central opening gas-tightly mounting said lamp bulb in said central opening, wherein said circular mounting member is of generally cup-shaped configuration and has a rearwardly located bottom wall provided with openings, and and wherein said mounting means further includes a plurality of tubular members each located in one of said openings in said bottom wall and each guiding a portion of a respective one of said electrodes located outside and rearwardly of said rear portion of said lamp bulb, and further including a plurality of glass melts each mounting a respective one of said tubular members in place in the respective one of said openings in said bottom wall.

7. In a headlight as defined in claim 6, wherein the material of said circular mounting member is a metal having a softening temperature higher than the softening temperature of the glass of said glass melts.

8. In a headlight as defined in claim 7, wherein said metal is high-grade steel.

9. In a headlight as defined in claim 6, wherein the material of said tubular members is glass.

10. In a gas-tightly sealed headlight for automotive vehicles and the like, a combination comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrode; and mounting means mounting said lamp bulb on said reflector in the region of said smaller open end of said reflector with at least part of said lamp bulb projecting forwardly into the interior of said reflector, wherein said mounting means comprises a plurality of tubular members each guiding a respective one of said electrodes and each being partially embedded within the material of said squashed-flat rear portion of said lamp bulb, with the remainder of each of said tubular members projecting rearwardly therefrom, and wherein said mounting means further includes a mounting member having a radially outer portion connected to said reflector in the region of said smaller open end of said reflector and having a plurality of central openings, each of said central openings accommodating one of said tubular members, a plurality of glass melts each fixing a respective one of said tubular members in position in the respective central opening, and wherein said lugs are connected to said electrodes rearwardly of said tubular members, said lamp bulb deriving support in said reflector from the connection between said tubular members, said squashed-flat rear portion and said mounting member.

11. In a headlight as defined in claim 10, wherein said mounting member is a flat member.

12. In a headlight as defined in claim 10, wherein said tubular members are glass tubular members.

13. In a headlight as defined in claim 10, wherein said mounting member and said reflector together consitute a weldment exhibiting a gas-tight annular weld seam at said radially outer portion of said mounting member in the region of said smaller open end of said reflector.

14. In a headlight as defined in claim 10, further including at least one body of solder gas-tightly connecting said radially outer portion of said mounting member to said reflector in the region of said smaller open end of said reflector.

15. In a gas-tightly sealed headlight for automotive vehicles and the like, a combination comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes; and mounting means mounting said lamp bulb on said reflector in the region of said smaller open end of said reflector with at least part of said lamp bulb projecting forwardly into the interior of said reflector, wherein said mounting means comprises a mounting member having a radially outer portion and having a central opening, means gas-tightly connecting said radially outer portion of said mounting member to said reflector in the region of said smaller open end of said reflector, said central opening being bounded by an inner peripheral portion of said mounting member, and said inner peripheral portion being entirely embedded within the material of said squashed-flat rear portion of said lamp, and said lamp bulb deriving support from the embedment of said member in the material of said lamp bulb.

16. In a headlight as defined in claim 15, wherein said mounting member is a flat mounting member.

17. In a headlight as defined in claim 15, and further including a plurality of tubular members each guiding a respective one of said electrodes and each being partially embedded within the material of said squashed-flat rear portion of said lamp bulb, with the remainder of each of said tubular members projecting rearwardly therefrom, and wherein said lugs are connected to said electrodes rearwardly of said tubular members.

18. In a gas-tightly sealed headlight for automotive vehicles and the like, a combination comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes; and mounting means mounting said lamp bulb on said reflector in the region of said smaller open end of said reflector with at least part of said lamp bulb projecting forwardly into the interior of said reflector, wherein said cup-shaped reflector is a one-piece body, wherein said mounting means includes one and only one circular mounting member having a radially outer portion and having central opening, at least a portion of said squashed-flat rear portion of said lamp bulb being received within said central opening, wherein said mounting means further includes at least one body of solder gas-tightly connecting said radially outer portion of said mounting member to said reflector in the region of said smaller open end of said reflector, wherein said circular mounting member has a plurality of openings in the central portion thereof, wherein each of said electrodes extends from said squashed-flat rear portion of said lamp bulb across free space a predetermined distance and then passes through a respective one of said plurality of openings, and wherein said mounting means further includes a plurality of glass melts, each glass melt completely surrounding a respective one of said electrodes at the portion of the respective electrode located within the respective one of said plurality of openings and gas-tightly sealing the respective one of said plurality of openings.

19. In a gas-tightly sealed headlight for automotive vehicles and the like, a combination comprising a cup-shaped reflector having a larger open end and a smaller open end; a lamp comprised of a lamp bulb having a fused, squashed-flat rear portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes; and mounting means mountng said lamp bulb on said reflector in the region of said smaller open end of said reflector with at least part of said lamp bulb projecting forwardly into the interior of said reflector, wherein said cup-shaped reflector is a one-piece body, wherein said mounting means includes one and only one circular mounting member having a radially outer portion and having a central opening, at least a portion of said squashed-flat rear portion of said lamp bulb being received within said central opening, and wherein said mounting member and said reflector together constitutes a weldment exhibiting a gas-tight annular weld seam at said radially outer portion of said mounting member in the region of said smaller open end of said reflector, wherein said circular mounting member has a plurality of openings in the central portion thereof, wherein each of said electrodes extends from said squashed-flat rear portion of said lamp bulb across free space a predetermined distance and then passes through a respective one of said plurality of openings, and wherein said mounting means further includes a plurality of tubular members, each tubular member being received within a respective one of said plurality of openings and surrounding a respective one of said electrodes, and glass melts mounting the tubular members in position within the respective ones of said plurality of openings and gas-tightly sealing off the space between the exterior of each tubular member and the rim of the associated one of said plurality of openings.

20. In a gas-tightly sealed headlight for automotive vehicles and the like, a combination comprising a cup-shaped reflector having a larger open end and a smaller open end; a lamp comprised of a lamp bulb having a fused, squashed-flat portion hermetically sealing the interior of said bulb and a plurality of lamp electrodes passing through said squashed-flat rear portion of said lamp bulb and embedded within the material of said squashed-flat rear portion of said lamp bulb; a plurality of lugs each connected to one of said lamp electrodes at the rear of said lamp in electrically conductive engagement with said electrodes; and mounting means mounting said lamp bulb on said reflector in the region of said smaller open end of said reflector with at least part of said lamp bulb projecting forwardly into the interior of said reflector, wherein said cup-shaped reflector is a one-piece body, wherein said mounting means includes one and only one circular mounting member having a radially outer portion and having a central opening, at least a portion of said squashed-flat rear portion of said lamp bulb being received within said central opening, wherein said mounting means further includes at least one body of solder gas-tightly connecting said radially outer portion of said mounting member to said reflector in the region of said smaller open end of said reflector, wherein said circular mounting member has a plurality of openings in the central portion thereof, wherein each of said electrodes extends from said squashed-flat rear portion of said lamp bulb across free space a predetermined distance and then passes through a respective one of said plurality of openings, and wherein said mounting means further includes a plurality of tubular members, each tubular member being received within a respective one of said plurality of openings and surrounding a respective one of said electrodes, and glass melts mounting the tubular members in position within the respective ones of said plurality of openings and gas-tightly sealing off the space between the exterior of each tubular member and the rim of the associated one of said plurality of openings.

21. In a headlight as defined in claim 18, wherein said lugs are projecting lugs of a configuration and stiffness rendering them insertable into sockets.

22. In a headlight as defined in claim 18, including at least one body of solder connecting said lugs to said electrodes.

23. In a headlight as defined in claim 18, said mounting means further including a body of cementing material filling the space intermediate the periphery of said squashed-flat rear portion of said bulb and the periphery of said central opening gas-tightly mounting said lamp bulb in said central opening.

24. In a headlight as defined in claim 18, wherein said lamp is a halogen lamp.

* * * * *